US009322598B2

(12) United States Patent
Eichelkraut et al.

(10) Patent No.: US 9,322,598 B2
(45) Date of Patent: Apr. 26, 2016

(54) PROCESS FOR THE HEAT TREATMENT OF STEEL STRIPS

(75) Inventors: Herbert Eichelkraut, Kempen (DE); Hans-Joachim Heiler, Moers (DE); Werner Högner, Essen (DE); Fred Jindra, Lennestadt (DE); Rainhard Paul, Asendorf (DE); Ola Ritzén, Åkersberga (SE)

(73) Assignee: Linde Aktiengesellschaft, Munich (DE)

( * ) Notice: Subject to any disclaimer, the term of this patent is extended or adjusted under 35 U.S.C. 154(b) by 152 days.

(21) Appl. No.: 12/162,641

(22) PCT Filed: Jan. 11, 2007

(86) PCT No.: PCT/EP2007/000219

§ 371 (c)(1),
(2), (4) Date: Oct. 15, 2008

(87) PCT Pub. No.: WO2007/087973

PCT Pub. Date: Aug. 9, 2007

(65) Prior Publication Data

US 2009/0188591 A1 Jul. 30, 2009

(30) Foreign Application Priority Data

Feb. 3, 2006 (DE) ..... 10 2006 005 063
Apr. 4, 2006 (EP) ..... 06007147

(51) Int. Cl.

| | |
|---|---|
| ***C21D 8/02*** | (2006.01) |
| ***F27D 19/00*** | (2006.01) |
| ***C21D 1/52*** | (2006.01) |
| ***C21D 9/46*** | (2006.01) |
| ***C21D 9/56*** | (2006.01) |
| *F26B 25/00* | (2006.01) |
| *C21D 9/63* | (2006.01) |
| *C21D 11/00* | (2006.01) |
| *F27D 99/00* | (2010.01) |

(52) U.S. Cl.
CPC *F27D 19/00* (2013.01); *C21D 1/52* (2013.01); *C21D 9/46* (2013.01); *C21D 9/561* (2013.01); *C21D 9/63* (2013.01); *C21D 11/00* (2013.01); *F27D 99/0033* (2013.01)

(58) Field of Classification Search
CPC ..... C21D 1/52; C21D 9/46; C21D 9/561; C21D 11/00; C21D 9/63
USPC ..... 148/579; 432/8
See application file for complete search history.

(56) References Cited

U.S. PATENT DOCUMENTS

| | | | | |
|---|---|---|---|---|
| 6,761,779 | B2 * | 7/2004 | Delaunay et al. | 148/559 |
| 2005/0115648 | A1 * | 6/2005 | Axelsson et al. | 148/605 |

FOREIGN PATENT DOCUMENTS

| | | | |
|---|---|---|---|
| DE | 30 15 461 | A1 | 6/1981 |
| JP | 55 091943 | A | 7/1980 |

(Continued)

*Primary Examiner* — Rebecca Lee
(74) *Attorney, Agent, or Firm* — Joshua L. Cohen

(57) ABSTRACT

The invention provides a process for the heat treatment of steel products, in particular of steel strips or sheets, in which the product is brought from a starting temperature to a target temperature in a booster zone having at least one burner; the burner is operated with a fuel, in particular a fuel gas, and an oxygen-containing gas which contains more than 21% oxygen; and the product is brought into direct contact with the flame generated by the burner, the air ratio λ within the flame being set as a function of the starting temperature and/or the target temperature.

9 Claims, 4 Drawing Sheets

(56) References Cited

FOREIGN PATENT DOCUMENTS

| | | | |
|---|---|---|---|
| JP | 56 149513 | A | 11/1981 |
| JP | 60 215716 | A | 10/1985 |
| JP | 07 310117 | | 11/1995 |
| WO | WO 03/070992 | A1 | 8/2003 |
| WO | WO 2004/097318 | A3 | 11/2004 |

* cited by examiner

PROCESS FOR THE HEAT TREATMENT OF STEEL STRIPS

The invention relates to a process for the heat treatment of steel products, in particular of steel strips or sheets.

To produce coated (e.g. hot-dip galvanized) steel strips, the strips to be coated are first of all cleaned, are heated in a continuous furnace and are then annealed in a reducing atmosphere to produce the desired materials properties. This is followed by the actual coating operation in a suitable melt bath or using an appropriate process.

During the heating phase in the continuous furnace, the steel is to be heated under defined conditions in order to allow better setting of the required properties in the subsequent process steps. Depending on the type of steel used, it may be expedient for the oxidation to be minimized or to deliberately effect a certain degree of oxidation.

Hitherto, the heating of the steel strips has been carried out in continuous furnaces in which the steel strips pass through a convection zone and a heat-up zone. In the heat-up zone, the strips are heated using burners, and in the convection zone connected upstream of it they are heated by the hot flue gases from the burners of the heat-up zone. In particular in the convection zone, the degree of oxidation is difficult to control, since the temperature profile in this zone is dependent, inter alia, on the length of the convection zone and the temperature and quantity of the flue gases.

The composition of the flue gases in the convection zone is determined by the operating mode of the burners and if appropriate by leaked air penetrating into the continuous furnace. This means that the heating conditions in the convection zone are substantially determined by the demands imposed on the burners in the heat-up zone. For these reasons, controlled adjustment of the temperature profile in the convection zone has not hitherto been possible.

SUMMARY OF THE INVENTION

Therefore, it is an object of the present invention to develop a process for the heat treatment of steel products which allows controlled setting of the heating conditions.

This object is achieved by a process for the heat treatment of steel products, in particular of steel strips or sheets, in which the product, in a booster zone having at least one burner, is brought from a starting temperature to a target temperature, the burner or burners being operated with a fuel, in particular a fuel gas, and an oxygen-containing gas, the oxygen-containing gas containing more than 21% oxygen, and the product coming into direct contact with the flame(s) generated by the burner(s), and which is characterized in that the product is moved through the booster zone in a conveying direction, and in that the flame surrounds the product over its entire periphery transversely to the conveying direction and that within the flame the air ratio $\lambda$ is set as a function of the starting temperature and/or the target temperature.

The term "booster zone" is to be understood as meaning a heat treatment furnace or a zone of a heat treatment furnace in which there is at least one burner which is operated with a fuel gas and an oxygen-containing gas, the oxygen-containing gas containing more than 21% oxygen. The burner is arranged or operated in such a way that the product to be treated comes into direct contact with the flame of the burner.

The air ratio $\lambda$ indicates the ratio of the oxygen quantity supplied during combustion to the oxygen quantity required for stoichiometric conversion of the fuel used. With an excess of oxygen, $\lambda$ is >1, i.e. the combustion takes place under superstoichiometric conditions. Accordingly, a substoichiometric reaction with a lack of oxygen is denoted by $\lambda<1$.

According to the invention the flame or the flames are very close to the surface of the steel product. The steel surface acts as a catalyst and any non-reacted fuel is post-combusted at the steel surface. By enclosing the steel product over its entire cross section by the flames a uniform and well-defined heating and treatment atmosphere is created at the surface. Thereby, the surface properties of the steel product can be modified in a well-defined manner and, for example, it is possible to oxidise the steel surface to a specific pre-determined degree.

The invention is well-suited for the treatment of cold-rolled and hot-rolled steels. By oxidizing the steel surface according to the invention the steel is well-prepared for subsequent coating or galvanizing.

The terms starting temperature and target temperature in each case refer to the surface temperature or, depending on the material thickness, the core temperature of the steel product respectively before and after the treatment using the burner or burners of the booster zone. In the case of thin sheets with a thickness of up to 5 mm, the surface temperature and the core temperature are very close together. In the case of thicker workpieces, however, these temperatures may differ considerably from one another. In the latter case, either the surface temperature or the core temperature are selected as the starting and target temperature, depending on the particular application.

In this case, the target temperature need not necessarily be greater than the starting temperature. It is also within the scope of the present invention for the temperature of the product to be kept at a constant level in the booster zone. In this case, the starting temperature and target temperature are identical. It is even conceivable for the target temperature to be below the starting temperature, for example if the steel product is being cooled in some way and the burner or burners of the booster zone are used to avoid excessive cooling or to control the degree of cooling.

According to the invention, therefore, the heat treatment of the steel products is carried out in a booster zone having a burner which is operated with a fuel, in particular a fuel gas, and more than 21% oxygen. The oxidizing agent used is oxygen-enriched air or technically pure oxygen. It is preferable for the oxygen content of the oxidizing agent to be more than 50%, particularly preferably more than 75%, very particularly preferably more than 90%.

The oxygen enrichment on the one hand achieves a higher flame temperature and therefore faster heating of the steel product, and on the other hand improves the oxidation properties.

According to the invention, the steel product is directly exposed to the flame of the burner, i.e. the steel product or part of the steel product comes into direct contact with the flame of the burner. Burners of this type, which are operated with a fuel and an oxygen-containing gas with an oxygen content of more than 21% and the flame of which is oriented in such a way that the steel product comes into direct contact with the flame, are also referred to below as booster burners. The booster burners can in principle be used at any desired location within the heat treatment process.

The conventional heating of steel strips in continuous furnaces is carried out using burners which are arranged above and/or below the steel strip and the flames of which are directed onto the surrounding refractory material of the furnace. The refractory material then radiates the thermal energy back onto the strip passing through the furnace. Therefore, the flame does not act directly on the steel strip, but rather only acts on it indirectly by means of the radiation from the refractory material which has been heated by the flame.

The direct action of the flame on the steel product in accordance with the invention allows the heat treatment conditions to be set in a defined way. According to the invention, within the flame the stoichiometry of the combustion, i.e. the air ratio λ, is selected as a function of the starting temperature and/or the target temperature.

Tests which formed the precursor to the invention revealed that it is favourable for the stoichiometry within the flame of the booster burner to be shifted in the direction of a lower oxygen content as the temperature of the steel product rises in order to achieve optimum heat treatment results.

For standard steels, by way of example the dependent relationship between the λ value and the temperature of the steel product shown in FIG. 1 has proven advantageous. For example, at 100° C. it is preferable to select a λ value of 1.12, at 200° C. a λ value of 1.07, at 400° C. a λ value of 1.00 and at 600° C. a λ value of 0.95. However, the heat treatment also has positive results within a λ value tolerance range of ±0.05. The way in which the λ value is dependent on the temperature may deviate from the curve illustrated in FIG. 1, depending on the type of steel.

It is advantageous for the λ value within the flame to be set as a function of the starting temperature of the steel product. However, it is also possible for the target temperature to be used as parameter for the selection of the λ value. In particular in the case of relatively rapid heating operations, in which the target temperature deviates significantly from the starting temperature, it has proven expedient for both temperatures, namely the starting temperature and the target temperature, to be taken into account in the selection of the λ value.

In addition to the booster zone according to the invention, it is advantageous to provide at least one further treatment zone, in which the product is brought from a starting temperature to a target temperature, in which case the λ value is preferably also set as a function of the respective starting temperature and/or the respective target temperature in the additional treatment zone. A defined heat treatment can in this way be carried out in the additional treatment zone(s) as well as in the booster zone.

It is particularly expedient if at least one of the additional treatment zones is likewise designed as a booster zone. In this process variant, therefore, there are at least two booster zones in which the steel product is heated using in each case at least one booster burner, i.e. a burner which is operated with oxygen or oxygen-enriched air and with a fuel and the flame of which acts directly on the steel product. In each of the booster zones, it is advantageous for the λ value to be set as a function of the starting temperature and/or target temperature of the respective booster zone.

The flue gas formed during operation of the booster burners is preferably afterburnt in the flue-gas duct as a function of its CO content.

It has proven advantageous for the product to be acted on by a heat flux density of 300 to 1000 kW/m2 in the booster zone. In other words, the heat capacity transferred to the steel product by the booster burners per square metre of surface area is from 300 to 1000 kW. Only the use according to the invention of oxygen-enriched air even through to the use of technical-grade oxygen with an oxygen content of more than 80% allows such a high level of heat transfer. As a result, the steel products can be heated more quickly over a shorter distance, with the result that either the length of the continuous furnaces can be considerably reduced or their throughput can be considerably increased.

It is particularly expedient for the product to be moved through the booster zone in a conveying direction, in which case the flame surrounds the product over its entire periphery transversely to the conveying direction. The steel product, for example a steel strip, is conveyed through the furnace along a conveying direction. The flame of at least one booster burner acts on the steel product transversely to this conveying direction, with the flame completely surrounding the steel product, i.e. at the treatment location the cross section of the steel product is completely within the flame. The flame encloses the steel product in the direction perpendicular to the conveying direction. This results in a uniform and, since the stoichiometry in the flame is set in accordance with the invention, defined heating of the steel product over its entire cross section.

Depending on the shape and geometry of the steel product to be treated, it may be necessary for the edge regions and the core region of the steel product to be heated to different extents. In this case, it is expedient for the flame of the booster burner or booster burners not to be used as a completely enclosing flame, as stated above, but rather to be deliberately directed onto certain regions, for example only the edge regions, of the steel product.

The direct action of the flame of the booster burner on the steel product also enables the target temperature in the booster zone to be deliberately influenced by varying the geometry of the flame.

The invention is suitable in particular for the heat treatment of steel products, in particular steel strips or steel sheets, which are to be subjected to subsequent treatment/coating in a melt bath or another suitable process. For example, prior to hot-dip galvanization, it is advantageous for the products which are to be galvanized to be heat-treated in accordance with the invention.

BRIEF DESCRIPTION OF THE DRAWINGS

The invention and further details of the invention are explained in more detail below on the basis of exemplary embodiments illustrated in the drawings, in which.

DESCRIPTION OF THE INVENTION

Figure 1:
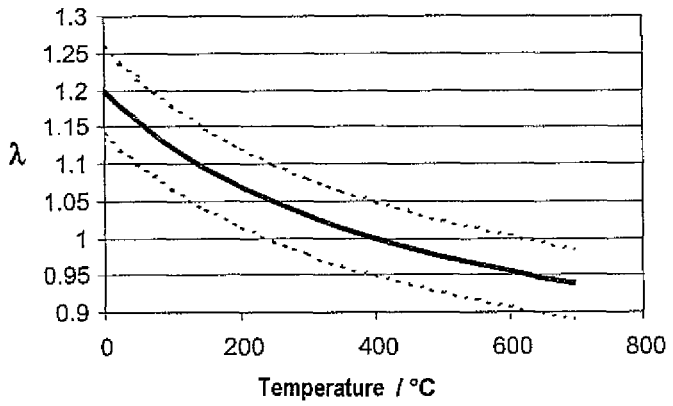
FIG. 1 shows the way in which the λ value is dependent on the temperature of the product to be treated.
Figure 2:
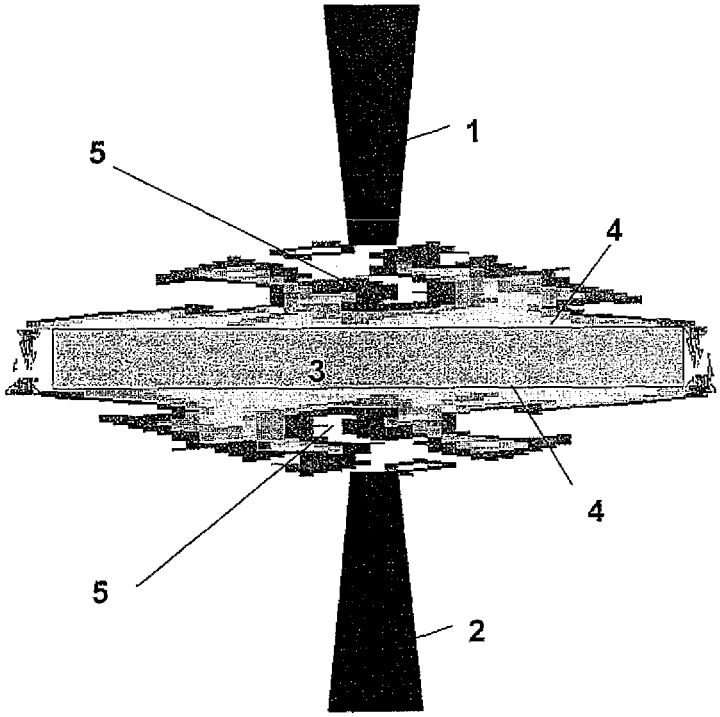
FIG. 2 shows the arrangement of the booster burners for generating an enclosing flame.

FIG. 2 shows two booster burners 1, 2 which are used in accordance with the invention to heat a steel strip 3 from a starting temperature to a target temperature. The strip 3 is conveyed through a continuous furnace (not shown) in a direction perpendicular to the plane of the drawing. The burners 1, 2 are arranged perpendicular to the conveying direction and perpendicular to the strip surface 4. The flames 5 generated by the booster burners 1, 2 enclose the entire cross section of the steel strip 3. Within the flames 5, the stoichiometry is set in a defined way as a function of the starting temperature and the target temperature. The enclosing flames 5 according to the invention ensure a uniform, defined heating and treatment of the steel strip 3.

The process according to the invention is preferably used to clean and/or heat steel products in strip form in continuous furnaces. The invention offers particular advantages for the heating or pretreatment of steel products prior to a subsequent coating/hot-dip galvanization process. The following FIGS. 3 to 7 show various possible arrangements of one or more booster zones in a continuous furnace, in particular in a continuous furnace in which the working steps which usually precede a hot-dip galvanization process are carried out.

Figure 3:
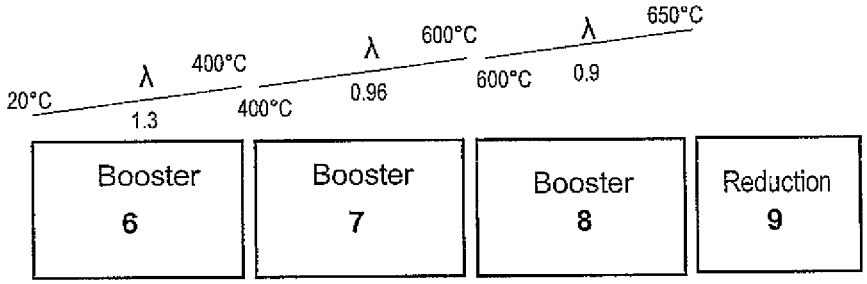
FIG. 3 shows the arrangement of three booster zones for preheating a steel strip in a continuous furnace.

FIG. 3 diagrammatically depicts the use of booster zones for cleaning and preheating steel strips. A steel strip which has been produced by cold rolling/hot rolling is to be heat-treated for a subsequent, for example, hot-dip galvanization. For this purpose, the steel strip, which is at room temperature, is fed to a first booster zone 6, in which the strip is substantially cleaned and preheated in a first stage. In accordance with the low starting temperature of the strip, a relatively high λ value of 1.3 is selected in this zone and the steel strip is heated to 400° C. under these superstoichiometric conditions.

For the further heating of the steel strip, there are two booster zones 7, 8, in which the strip is heated firstly from 400° C. to 600° C. and then to the desired finishing temperature of 650° C. For this purpose, the steel strip in both booster zones 7, 8, as also in booster zone 6, is in each case heated using a plurality of burners operated with oxygen-enriched air and a fuel gas, the flames of the burners acting directly on the steel strip. The burners are preferably arranged in such a way that the steel strip, as shown in FIG. 2, is completely enclosed by the flames of the burners over its cross section. The λ value in the burner flames in booster zone 7 is in this case set to a value of 0.96, and the λ value of the burner flames in booster zone 8 is set to a value of 0.90. After it has passed through the booster zones 6, 7, 8, the steel strip is exposed to a reducing atmosphere in a furnace section 9.

Figure 4:
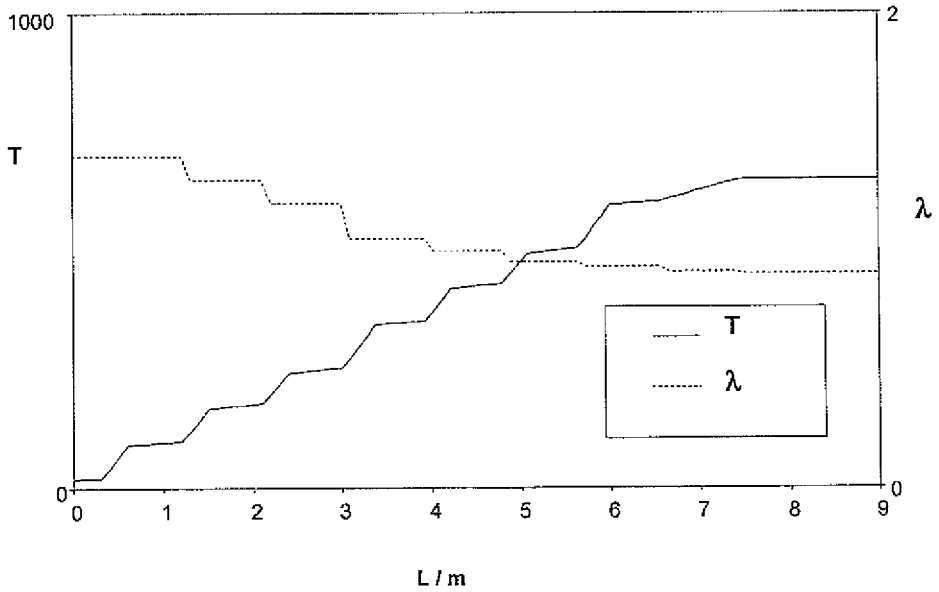
FIG. 4 shows the curve of the λ value and the temperature of the steel product in one specific embodiment of the invention.

FIG. 4 illustrates the curve of the temperature of a steel strip that is to be heated and the λ value within the flames heating the steel strip over the length of a different heat treatment furnace. The furnace is in this case divided over its length L into a plurality of booster zones, the λ value in each booster zone being reduced in steps according to the respective starting temperature of this booster zone. The result is optimum matching of the heat treatment conditions to the instantaneous temperature conditions.

Figure 5:
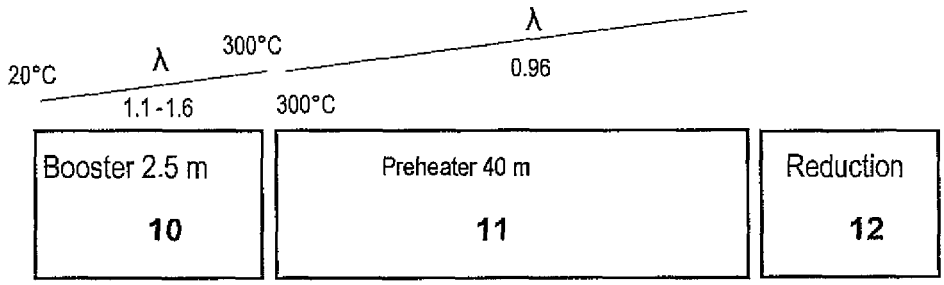
FIG. 5 shows the use of a booster zone for cleaning the steel product.

FIG. 5 shows an embodiment of the invention in which the booster burner(s) is/are used to clean a steel sheet which is contaminated with rolling residues following the hot and/or cold rolling. A booster zone 10 is set up over the first 2.5 m of the furnace length. In this short zone 10, the steel strip is heated from 20° C. to 300° C. and rolling residues which are present are burnt. In this zone 10, the λ value is set to a value of between 1.1 and 1.6, i.e. superstoichiometric combustion conditions are established.

The booster zone 10 is adjoined by a 40 m long preheating zone 11, in which the steel strip is brought to the desired target temperature of, for example, 650° C. The heating in the preheating zone 11 is carried out under substoichiometric conditions with a λ value of 0.96 before the steel strip is transported into a reduction furnace 12.

Figure 6:
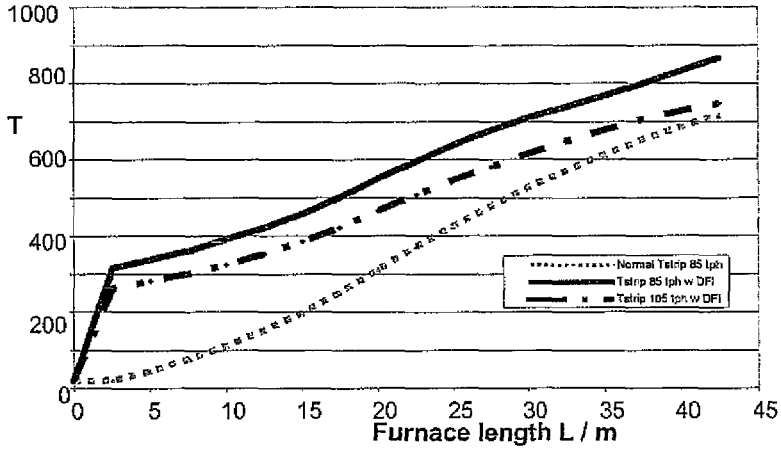
FIG. 6 shows the way in which the steel temperature is dependent on the furnace length in an arrangement as shown in FIG. 5.

FIG. 6 illustrates the temperature of the steel strip as a function of its position in a continuous furnace as shown in FIG. 5. The dotted line shows the temperature curve when using a conventional burner arrangement in the booster zone 10, i.e. without the booster burners according to the invention. The temperature of the strip rises only slowly; in the first zone 10, only an insignificant increase in temperature is observed.

By contrast, the solid line shows the temperature curve when using booster burners in the booster zone 10 as described with reference to FIG. 5. An increase in temperature to over 300° C. is achieved within the first 2.5 m of furnace length, i.e. in the booster zone 10. It is in this way possible to increase the furnace capacity by 25%. The solid line shows the temperature curve for a production rate of 85 tones per hour, whereas the dot-dashed line represents the temperature curve if production is increased to 105 tones per hour.

Figure 7:
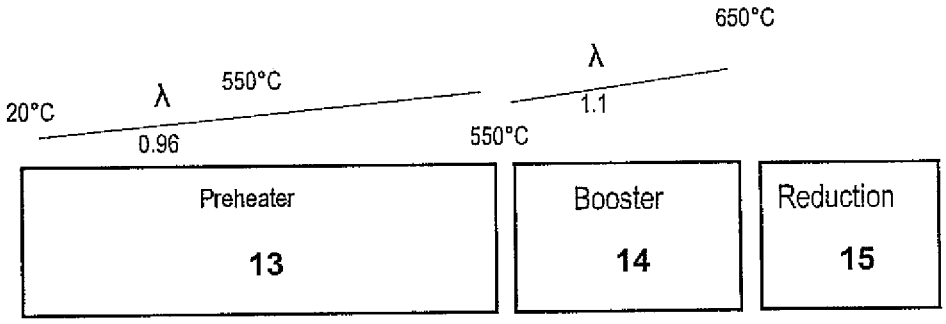
FIG. 7 shows the use of a booster zone following a conventional preheating zone.

Finally, FIG. 7 shows a variant of the invention, in which the booster zone 14 is arranged immediately upstream of the reduction zone 15 of the heat treatment furnace. First of all, the steel product is heated from ambient temperature to 550° C. in a conventional preheating zone. This is followed by a booster zone 14, in which the steel product is heated to 650° C. In this specific case, the booster burners are operated under superstoichiometric conditions with a λ value of 1.1 in order to effect controlled oxidation of the steel strip in the booster zone 14.

In addition to the arrangements shown in the figures, the booster zone or zones may also be positioned at other locations within the heat treatment process. In principle, a booster zone can usefully be employed anywhere that the steel product is to be heat-treated as quickly as possible in a defined atmosphere.

In particular, it has also proven favourable for the steel product to be subjected to a heat treatment according to the invention in a booster zone following a reducing heat treatment. In this booster zone, it is preferable for the temperature of the steel product to be only slightly increased or even to be held at the same temperature level. In this case, the booster zone is used to influence the material in a controlled way by means of a defined atmosphere, i.e. to set the surface, the properties or the microstructure of the steel product in a desired way.

What is claimed is:

1. A method for the heat treatment of steel products to be treated in a furnace, wherein a steel product in a booster zone having at least one burner is brought from a starting temperature to a target temperature, the at least one burner operating with a fuel and an oxygen-containing gas, the oxygen-containing gas including more than 21% oxygen and the steel product directly contacting a flame generated by the at least one burner, the method comprising:

moving the steel product through the booster zone upstream of the furnace in a conveying direction to the furnace, providing the flame in a direction transverse to the conveying direction and directly contacting the steel product with the flame, surrounding the steel product over its entire periphery with the flame provided transversely to the conveying direction, and providing an air ratio λ within the flame set as a function of the starting temperature and/or the target temperature in the booster zone.

2. The method according to claim 1 further comprising:

providing additional booster zones in which the steel product in each of said additional booster zones is brought from a starting temperature to a target temperature, and setting the air ratio λ as a function of the respective starting temperature and/or the respective target temperature in each of the additional booster zones.

3. The method according to claim 2, further comprising:

providing at least one additional burner operated with fuel and a gas containing more than 21% oxygen for each one of said additional booster zones, heating each one of said additional booster zones with a corresponding one of, said additional burners, and contacting the steel product directly with the flame generated by the at least one additional burner.

4. The method according to claim 1, further comprising acting on the steel product with a heat flux density of 300 to 1000 kW/m2 in the booster zone.

5. The method according to claim 1, further comprising influencing the target temperature in the booster zone using a flame geometry of the at least one burner.

6. The method according to claim 1, further comprising:

heating the steel product to a first target temperature of 300°C. to 400°C. in the booster zone, and heating the steel product from the first target temperature to a temperature of from 600° C. to 900° C. in at least one further treatment zone.

7. The method according to claim 1, further comprising:

heating the steel product to a first target temperature of from 500° C. to 600° C. in a first treatment zone, and heating the steel product from the first target temperature to a temperature of from 600° C. to 900° C. in the booster zone.

8. The method according to claim 1, further comprising subjecting the steel product to a coating/galvanization process.

9. The method according to claim 1, further comprising:

exposing the steel product to a reducing atmosphere, and providing the steel product to the booster zone for heating to the target temperature.

* * * * *